United States Patent [19]

McCann et al.

[11] Patent Number: 4,986,447

[45] **Date of Patent: * Jan. 22, 1991**

[54] BEVERAGE DISTRIBUTION SYSTEM

[75] Inventors: Gerald P. McCann, Los Angeles; Andrew J. Holoubek, Burbank, both of Calif.

[73] Assignee: McCann's Engineering and Manufacturing, Co., Los Angeles, Calif.

[ * ] Notice: The portion of the term of this patent subsequent to May 29, 2007 has been disclaimed.

[21] Appl. No.: 374,088

[22] Filed: Jun. 30, 1989

Related U.S. Application Data

[63] Continuation-in-part of Ser. No. 195,947, May 19, 1988, Pat. No. 4,928,854.

[51] Int. Cl.[5] ..... B67D 5/56

[52] U.S. Cl. ..... 222/129.1; 222/145; 222/148; 239/419.3

[58] Field of Search ..... 222/129.1–129.4, 222/148, 481, 145, 488; 239/419.3, 419, 424, 422, 427.3, 427.5, 106, 432

[56] References Cited

U.S. PATENT DOCUMENTS

| | | | |
|---|---|---|---|
| 1,329,601 | 2/1920 | Hinsdale | 239/106 |
| 3,423,028 | 1/1969 | Stupakis | 239/419.3 |
| 3,717,284 | 2/1973 | Garrard | 222/129.1 |
| 3,898,861 | 8/1975 | McMillin | 222/148 |
| 3,966,091 | 6/1976 | Bencic | 222/129.1 |
| 4,218,014 | 8/1980 | Tracy | 239/106 |
| 4,270,673 | 6/1981 | Rodth | 222/129.1 |
| 4,765,513 | 8/1988 | McMillin et al. | 222/148 |
| 4,903,862 | 2/1990 | Shannon et al. | 222/129.1 X |
| 4,928,854 | 5/1990 | McCann et al. | 222/129.1 |

*Primary Examiner*—Andres Kashnikow
*Assistant Examiner*—Gregory L. Husen
*Attorney, Agent, or Firm*—Lyon & Lyon

[57] ABSTRACT

A superflow diffuser and spout assembly including an inlet for carbonated water, an inlet for syrup, a diffuser assembly through which the carbonated water passes prior to being dispensed, a spout, a syrup distributor, and a flow separator within the path of the carbonated water, the flow separator being operative to separate the carbonated water into at least two streams, one stream directed to flow along an outside surface of the spout, the second stream directed to flow inside the spout, the second stream colliding with and mixing with syrup distributed within the spout. The first stream of carbonated water and the second stream of carbonated water, then mixed with syrup, meet and form a single stream to be dispensed in a second embodiment, a syrup distributor has a plurality of inlets for different flavored syrups and a shroud located within the spout between the syrup distributor and an inner surface of the spout. The shroud may be adapted for use with the single syrup flavor embodiment of the present invention. A third embodiment includes an improved diffuser assembly and spout configuration. Also provided are additional diluent channels adapted to transport a portion of the diluent into the beverage concentrate stream; the beverage concentrate stream at this time being already mixed with diluent.

4 Claims, 3 Drawing Sheets

BEVERAGE DISTRIBUTION SYSTEM

CROSS-REFERENCE TO RELATED APPLICATION

This application is a continuation-in-part of co-pending application, Ser. No. 195,947, filed May 19, 1988, now U.S. Pat. No. 4,928,854 issuing May 29, 1990, entitled "Superflow Diffuser and Spout Assembly."

FIELD OF THE INVENTION

This invention relates to improvements in diffusers and spout assemblies, and, in particular, the development of diffusers and spout assemblies which are useful to dispense carbonated drinking liquids, such as soft drinks, at flow rates substantially greater than flow rates available from existing diffusers and spout assemblies with an attendant improvement in the quality of the drink.

BACKGROUND OF THE INVENTION

In the vending machine and soft drink dispensing industry it is well known that a basic problem exists with regard to increasing the flow rate of dispensed liquids above the standard one and one-half to three ounces per second. This basic problem manifests itself in excessive foaming of the drink, which causes spillage and overflow. In addition, excessive foaming reduces the efficiency of the operator responsible for dispensing the drinks, because excessive foaming requires the operator to terminate the filling cycle early to permit foam reduction, then re-initiate the filling cycle to "top off" the drink.

Nevertheless, it is desirable that flow rates be maximized to reduce the time required to dispense the soft drink, thus providing improved customer service or reducing the number of attendants required at the work station. Increased flow rate drink dispensers are particularly desirable at high-volume operations such as movie theaters and amusement parks.

Conventional diffusers and spouts used with existing dispensing equipment do not function well when scaled up to flow rates of 5 ounces per second or more. Using conventional equipment, when the flow rate is increased to in excess of 3 ounces per second undesirable hissing occurs at the spout or excessive foaming results from the mixing that occurs between the carbonated water and the syrup. Furthermore, at high flow rates the quality of the drink is known to decrease because of stratification of the syrup or excessive loss of carbon dioxide.

It is known that high pressure carbonated water, typically in the range of 60–120 PSIG, used with conventional dispensing equipment, must gently be reduced to atmospheric pressure so as to lose a minimum of carbon dioxide. In existing equipment the methods of pressure reduction result in excessive out-gassing of the carbon dioxide at high flow rates, thus causing excessive foaming of the drink with the attendant reduction in efficiency of the operator and waste of the product. Also, this excessive out-gassing results in a "flat" drink.

Various methods have been previously devised to reduce foaming of the drink, yet attempt to maintain the quality of the drink. The most conventional method to reduce foaming of the drink is to provide a restricted passage in the flow, thus reducing the velocity of the carbonated water. However, by placing a restriction in the line the flow rate is substantially reduced to undesirable levels. In other dispensing devices a coiled feed line is provided to reduce foaming of the dispensed soft drink. Alternatively, it is possible to provide a series of chambers which are operative to reduce the pressure of carbon dioxide in the water at various stages in the diffuser and spout assembly. However, this approach has led to an excessive outgassing of the carbon dioxide, thus resulting in an undesirable reduction in the quality of the dispensed drink.

Existing diffusers and spout assemblies normally contain an inlet for the carbonated water and an inlet for the syrup. These inlets open into chambers which eventually meet at a common mixing chamber. The common mixing chamber opens into a spout for dispensing of the carbonated water/syrup mixture. A pressure reduction occurs at the first chamber, where the carbonated water or syrup is introduced, again at the mixing chamber and again at the spout. Thus, in conventional diffusers and spout assemblies pressure reduction occurs generally at only 2 or 3 locations, the result being a limitation in the potential flow rate, or if the chambers are made large enough to facilitate higher flow rates, an undesirable out-gassing of carbon dioxide from the carbonated water.

OBJECT AND SUMMARY OF THE INVENTION

It is a general object of the present invention to provide a new and improved diffuser and spout assembly capable of dispensing carbonated liquids at flow rates far in excess of those presently achievable.

Another object of the present invention is to provide a superflow diffuser and spout assembly which provides multiple stages of pressure reduction while achieving increased flow rates, yet maximizes carbon dioxide retention with an attendant reduction in foaming of the dispensed drink.

Another object of the present invention is to provide a superflow diffuser and spout assembly which will improve mixing of the syrup with carbonated water to achieve a higher quality drink.

Another object of the present invention is to provide a superflow diffuser and spout assembly which has self-cleaning capabilities.

Another object of the present invention is to provide a superflow diffuser and spout assembly which has the capability of dispensing multiple flavors with a self-cleaning capability.

Another object of the present invention is to provide a superflow diffuser and spout assembly capable of dispensing carbonated drinks at higher temperatures with increased flow rates.

Another object of the present invention is to provide a superflow diffuser and spout assembly which is capable of dispensing multiple flavors at higher flow rates than presently achievable.

Another object of the present invention is to provide a superflow diffuser and spout assembly which will dispense carbonated liquids at higher flow rates, with attenuated noise, than presently achievable.

Another object of the present invention is to provide a superflow diffuser and spout assembly which is capable of variable flow rates based upon the design of a diffuser assembly within the diffuser and spout assembly.

Another object of the present invention is to provide a superflow diffuser and spout assembly which improves mixing of the syrup with the carbonated water at higher than conventional flow rates.

Another object of the present invention is to provide a superflow diffuser and spout assembly which reduces out-gassing of carbon dioxide from the carbonated water resulting in improved drink quality.

The superflow diffuser and spout assembly of the present invention includes, in summary, an inlet for carbonated water, an inlet for syrup, a diffuser assembly through which the carbonated water flows prior to being dispensed, a syrup distributor, a spout, and a flow-separator within the path of the carbonated water, wherein the flow separator is operative to separate the carbonated water into at least two streams, a first stream directed to flow along an outside surface of the spout, the second stream directed to flow inside the spout, the second stream colliding with and mixing with syrup distributed inside the spout, wherein the first stream of carbonated water and the second stream of carbonated water, then mixed with syrup, meet and form a single stream for dispensing.

In a second embodiment of the superflow diffuser and spout assembly of the present invention, a syrup distributor is constructed to introduce different flavored syrups through a plurality of inlets, which will separately cause syrup to mix with carbonated water in a spout for dispensing. The second embodiment of the present invention includes a fitted shroud located within the spout between the syrup distributor and an inner surface of the spout; the shroud operative to facilitate cleansing of the inner surface of the spout to eliminate the possibility of residual syrup mixing with later-dispensed syrup of a different flavor. The shroud, adaptable for use with either the single flavor or multiple flavor embodiments of the present invention, is also operative to reduce the velocity of the distributed syrup resulting in a more gentle mixing of the syrup and carbonated water to reduce foaming.

A third embodiment of the superflow diffuser and spout assembly of the present invention includes an improved diffuser assembly and spout configuration, which includes additional diluent channels adapted to transport a portion of the diluent in a different manner into the beverage concentrate stream; the beverage concentrate stream at this time being already mixed with diluent. Also included in the third embodiment is a different spout configuration.

The foregoing and additional objects and features of the present invention will become apparent from the following description, in which the preferred embodiment has been set forth in detail, in conjunction with the accompanying drawings.

DESCRIPTION OF THE PREFERRED EMBODIMENT

Figure 1:
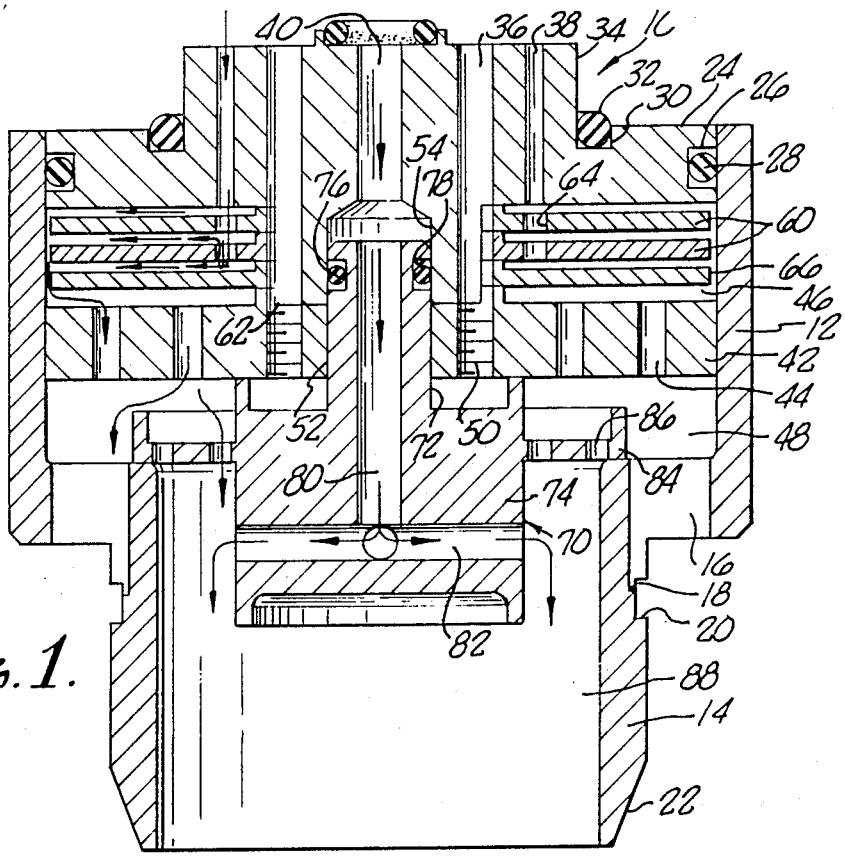
FIG. 1 is a side cross-sectional view of the superflow diffuser and spout assembly of the present invention.
Figure 2:
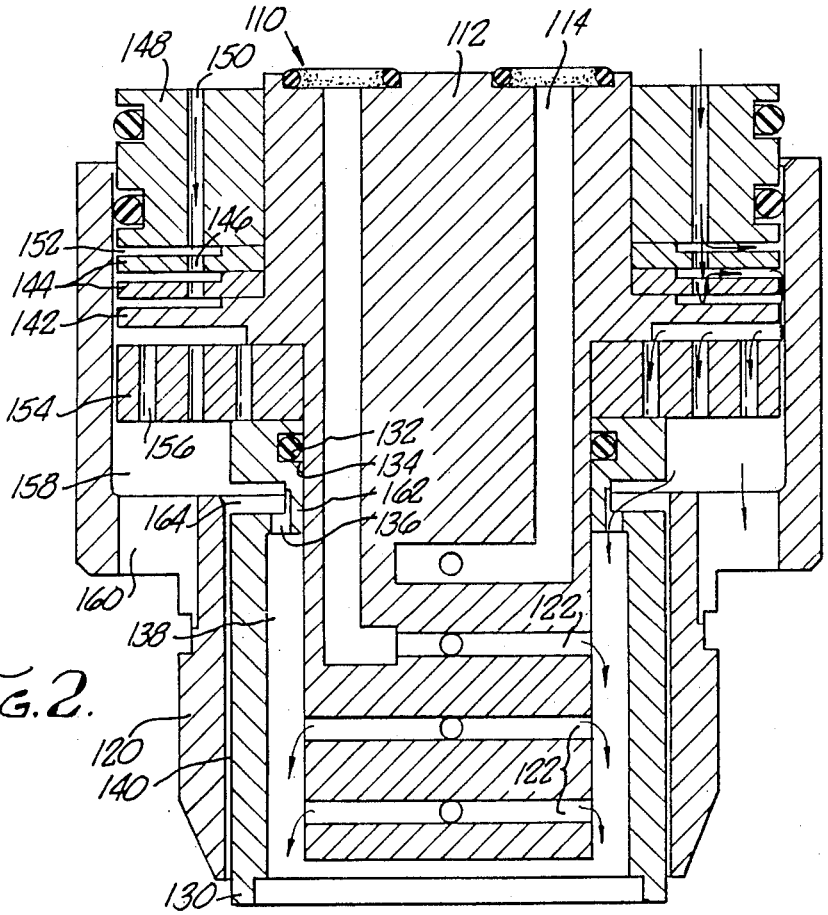
FIG. 2 is a side cross-sectional view of a second embodiment of the superflow diffuser and spout assembly of the present invention adapted to dispense syrups of different flavors.

Referring to the drawings, a superflow diffuser and spout assembly made in accordance with the present invention is shown in FIG. 1. The superflow diffuser and spout assembly 10 includes a body 12 and a spout 14. The body 12 is preferably integral with the spout 14 or the spout 14 may be a separate component attachable to the body 12. The body 12 is substantially cylindrical in shape, whereas the spout 14 is over an upper portion cylindrical in shape and over a lower portion substantially frustoconical.

The body 12 has a plurality of channels 16 formed in the lower portion of the body 12 circumferentially disposed around the spout 14. The channels 16 are positioned such that a first ridge 18 and a second ridge 20 formed along the outside wall of the spout 14 are operative to create turbulence in the liquid, as well as distribute an even flow of liquid around the entire perimeter of the spout 14; the liquid flowing along the outside surface of the spout 14. The purpose and importance of these ridges 18, 20 will be discussed in greater detail hereinafter in a discussion of the operation of the present invention. The spout 14 is formed such that an angled surface 22 is located at the lowermost portion of the spout 14 resulting in the substantially frustoconical configuration of the lower portion of the spout 14. The angled surface 22 directs the flow along the outside of the spout 14 into the flow passing through the inside of the spout 14 causing mixing of the two streams of liquid.

Figure 5:
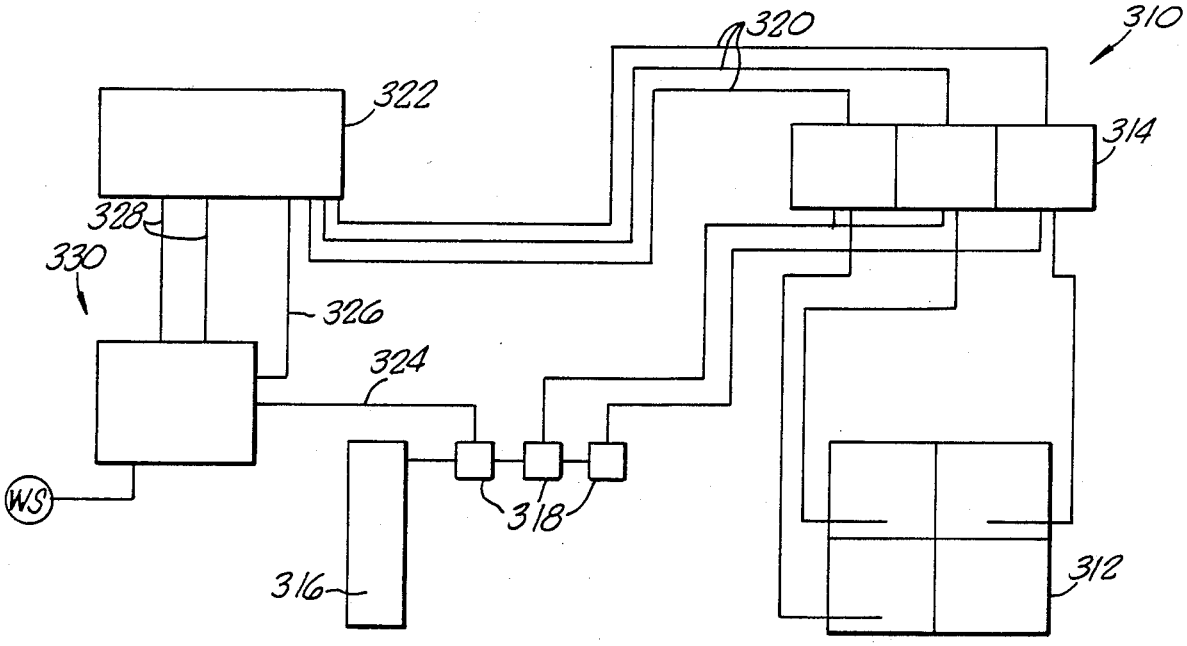
FIG. 5 is a block diagram illustrating other components of a beverage distribution system using the superflow diffuser and spout assembly of the present invention.
Figure 6:
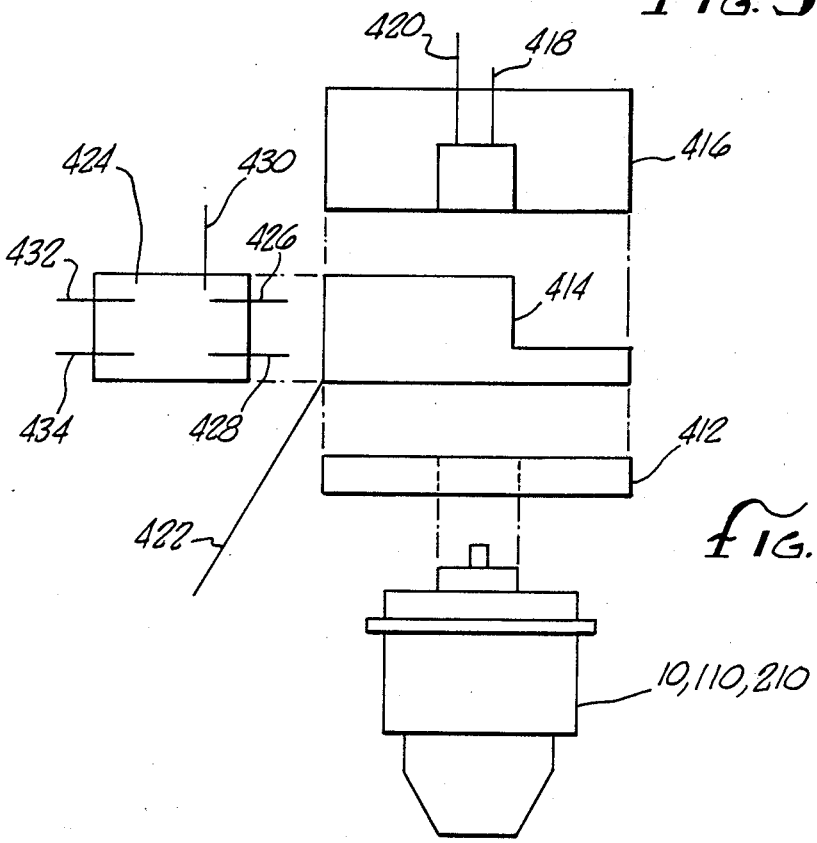
FIG. 6 is a block diagram illustrating the other components of a tower assembly using the superflow diffuser and spout assembly of the present invention.

Fitted within the body 12 of the superflow diffuser and spout assembly 10 is a first disk 24 which has a groove 26 disposed about its entire periphery. The groove 26 houses an O-ring 28 to retain the first disk 24 within the body 12 and to seal the inner cavity of the body 12 from the outside environment A second groove 30 is located along the upper surface of the disk 24 and houses a second 0-ring 32 which is operative to seal the superflow diffuser and spout assembly 10 when it is attached to other components of a beverage dispensing system including a dispensing tower, as shown in FIGS. 5 and 6, which will be discussed in greater detail hereinafter.

Extending upwardly from the disk 24 and integral therewith is a cylinder 34 which fits into the dispensing tower when the superflow diffuser and spout 10 is in position for use. The cylinder 34 includes multiple screw holes 36 into which are receivable screws to attach the first disk 24 to a second disk, which will be described in greater detail hereinafter.

A plurality of carbonated water inlets 38 are located within the cylinder 34 and are operative to receive carbonated water from a source existing in the dispensing tower. A syrup inlet 40 is located substantially in the center portion of the cylinder 34 and is attachable to a source of syrup existing in the dispensing tower.

Also located within the body 12 is a second disk 42 which is fitted snugly within the body 12 such that minimal flow is permitted between the periphery of the disk 42 and the inside wall of the body 12. The disk 42 is provided with a plurality of channels 44 connecting the cavity 46 with the cavity 48. Substantially in the center portion of the disk 42 are threaded channels 50 which receive the screws (not shown) which pass through the channels 36. Thus, the first disk 24 is rigidly attachable to the second disk 42, the resulting assembly being insertable into the body 12.

In the first embodiment, the second disk 42 is provided with numerous channels 44 which are equally spaced in a radially disposed position along the surface of the disk 42. Substantially in the center of the disk 42 is a center channel 52 which is substantially the same diameter as a channel 54 defined within the center portion of the first disk 24. Receivable into the channels 52, 54 is a syrup distributor and mixing assembly, which will be described in greater detail hereinafter.

Disposed between the first disk 24 and the second disk 42 are a plurality of diffuser elements 60 which are fitted about a cylindrical downwardly extending portion 62 of the first disk 24. The diffuser elements 60 are provided with a plurality of radially disposed channels 64 which are operative to permit passage of a portion of the carbonated water from the inlets 38 through the diffuser elements 60. The diffuser elements 60 are slightly smaller in diameter than the inside diameter of the body 12 such that a small annular passage is provided between the periphery of the diffuser elements 60 and the inner wall of the body 12.

A terminal diffuser 66 is also fitted about the cylindrical portion 62, however, the terminal diffuser 66 does not have any channels defined along its surface. Rather, all flow must pass outside of the periphery of the terminal diffuser 66 between the outer edge of the terminal diffuser 66 and the inner wall of the body 12.

The diffusers 60, 66 are maintained in a substantially parallel, yet separated, alignment by the affixing of the first disk 24 to the second disk 42 by the screws (not shown). It should be appreciated that although the first embodiment illustrates two diffuser elements 60 and a terminal diffuser 66 additional diffuser elements or other various forms of diffuser assemblies may be used without departing from the spirit of the present invention. It should also be appreciated that the diffuser elements 60 may be provided with slots, in addition to the channels, or other configurations of grooves or baffles to direct the flow of carbonated water within the chamber 46.

Fitted within the channel 52 and channel 54 is a syrup distributor 70 which is operative to direct syrup from the syrup input 40 into the interior of the spout 14. The syrup distributor 70 has a substantially vertical cylindrical section 72 extending upwardly from the body 74 of the syrup distributor 70 and adapted to fit snugly into the channel 52 and channel 54. Depending on relative pressures, soda from channel 52 may leak into the syrup in channel 80 or vice versa. An O-ring 76 is located within a groove 78 formed along the periphery of the cylinder 72 to prevent syrup from leaking into the channel 52 or to prevent soda in channel 52 from leaking into channel 80. The O-ring 76 also assists in snugly holding the syrup distributor 70 into the cylindrical portion 62 of the first disk 24.

The syrup distributor 70 has a channel 80 located substantially in the center of the body 74 which is in alignment with the syrup supply 40. A plurality of channels 82 open to the channel 80 are located substantially at the lower portion of the body 74 to direct the flow of syrup uniformly in multiple directions within the spout 14. Extending outwardly from the body 74 is a third disk 84 which is also provided with a plurality of radially disposed channels 86 which permit controlled and limited flow of the carbonated water from the chamber 48 into the interior chamber 88 of the spout 14.

In assembling the superflow diffuser and spout assembly of the present invention the diffuser elements 60 and terminal diffuser 66 are fitted about the cylindrical portion 62. When this is accomplished, the second disk 42 is affixed to the first disk 24 by the screws (not shown). The entire assembly consisting of the first disk 24, the diffuser elements 60, the terminal diffuser 66, and the second disk 42 is then attached to the dispensing tower by screws (not shown) from the lower side of the second disk 42. After this has been accomplished the cylinder 72 of the syrup distribution 70 is then fitted into the channels 52, 54. The entire assembly is then covered by the body 12.

In the first embodiment of the superflow diffuser and spout assembly 10 of the present invention the carbonated water inlet channels 38 are approximately 0.063 of an inch in diameter. In the first embodiment eight of the channels 38 are located within the cylinder 34. The channels 64 provided in the diffuser elements 60 are approximately 0.070 of an inch in diameter and number eight. The diffuser elements 60 are approximately 0.050 of an inch thick and a gap of approximately 0.030 of an inch exists between each of the diffuser elements 60. Approximately a 0.010 to 0.020 of an inch gap exists between the periphery of the diffuser elements 60 and the periphery of the terminal diffuser 66 and the inner wall of the body 12. Approximately a 0.055 of an inch gap exists between the lower surface of the terminal diffuser 66 and the upper surface of the second disk 42. The second disk 42 is provided with a plurality of channels 44 which are approximately 0.082 of an inch in diameter. The channels 86 are approximately 0.060 of an inch in diameter. It has been found that this configuration will result in flow rates of approximately 6 ounces per second at a carbonated water pressure of approximately 100 PSIG.

It should be appreciated that although the first embodiment of the present invention has been discussed in great detail above, other forms of diffusers can be located in the flow path of the carbonated water without departing from the spirit of the present invention. Consequently, although the present invention contemplates the use of a first disk 24, a second disk 42, a plurality of diffuser elements 60 and a terminal diffuser 66 other embodiments can be devised which accomplish the same function without departing from the spirit of the present invention.

Furthermore, other types of flow separators may be located within the cavity 48 to separate the flow of the carbonated water such that a portion of the carbonated water flows through the channels 16 and a portion of the carbonated water flows through the channels 86. Alternatively, all of the carbonated water flow can be directed either outside the spout 12 or inside the spout 12. It is the separation or direction of the flow of carbonated water within the diffuser and spout assembly which achieves the desired result not the precise configuration which results in the separated or directed flow.

The use of the superflow diffuser and spout assembly of the present invention will permit mixed soft drinks to be dispensed at flow rates of at least 6 ounces per second with a 5:1, or variable, finished drink mixture ratio of carbonated water to syrup. By varying the size and number of the channels located within the cylinder 34, the diffuser elements 60 and the second disk 42 varying flow rates can be achieved.

The operation of the superflow diffuser and spout assembly of the first embodiment of the present invention will now be discussed. It should be appreciated that the superflow diffuser and spout assembly of the present invention includes a diffuser of a unique design such that it drops the pressure of the carbonated water in a series of multiple stages.

The carbonated water initially enters the first disk 24 through the channels 38. A first pressure drop occurs within the channels 38. As the carbonated water flows through the channels 38 it enters the upper portion of the cavity 46 above the first diffuser element 60 wherein another pressure drop occurs. The carbonated water then passes through the channels 64 which function as capillaries to permit passage of a portion of the carbonated water through the diffuser elements 60. These channels 64 provide another stage of pressure reduction and their diameter and number may be varied depending upon the exact flow rate range and pressure reduction that is to be achieved.

Another stage of pressure reduction occurs as the carbonated water passes through a number of small chambers that are located between the diffuser elements 60 and the terminal diffuser 66. A portion of the carbonated water is allowed to flow radially outward where it must pass through several restricted annular spaces created between the periphery of the diffuser elements 60 and the terminal diffuser 66 and the inner wall of the body 12. Since there are no channels located within the terminal diffuser 66 all carbonated water must pass between the periphery of the terminal diffuser 66 and the inner wall of the body 12. This passage of carbonated water around the terminal diffuser 66 effectuates additional reduction in pressure of the carbonated water.

Another unique feature of the present invention is that a cross-current effect occurs within the diffuser section. This cross-current effect occurs because a portion of the carbonated water will pass through the channels 64 and a portion of the carbonated water will flow outwardly along the upper surfaces of the diffuser elements 60 and the terminal diffuser 66. As the carbonated water passes through the channels 64 it strikes the upper surface of the terminal diffuser 66 and is redirected back through the channels 64 thus increasing the cross-current effect and flooding the cavity 46. Furthermore, the stream of carbonated water flowing radially along the upper surface of the diffuser elements 60 and terminal diffuser 66 will collide with the flow of carbonated water passing along the inside wall of the body 12 to create additional pressure reduction. Because of this cross-current effect additional substantial pressure drop occurs within the diffuser section of the present invention.

When the flow of carbonated water about the outside edges of the diffuser elements 60 meets the outward flow along the top of the terminal diffuser 66 additional pressure drop is provided. The diameter of the diffuser elements 60 and 66 preferably have the same O.D. dimension to occasion a balancing of the flow.

To further dissipate the velocity of the carbonated water, as the carbonated water passes around the edge of the terminal diffuser 66 it is allowed to expand into the lower portion of the chamber 46 between the terminal diffuser 66 and the second disk 42. In this manner the carbonated water floods the lower portion of the chamber 46. The carbonated water then drops through the large number of channels 44 defined within the second disk 42. In the first embodiment it should be pointed out that the areas between the first disk 24 and the diffuser elements 60 and the terminal diffuser 66 are smaller than the area between the terminal diffuser 66 and the second disk 42. It has been determined that this results in a more balanced flooding of all areas between the diffuser elements 60 and the terminal diffuser 66.

Another stage of pressure drop occurs as the carbonated water passes through the multitude of channels 44 in the second disk 42. By sizing the channels 44 in accordance with desired flow rates and carbon dioxide retention, pressure drop of the carbonated water may be controlled. Yet another stage of pressure drop occurs as the carbonated water passes through the channels 44 and into the cavity 48. At this point the carbonated water is separated into two streams which occasions additional pressure drop. A first stream flows through the channels 16 defined within the lower portion of the body 12 and located about the spout 14. A second portion of the stream is diverted through the channels 86 defined within the disk 84 and is allowed to flow into the chamber 88 within the spout 14. Thus, another stage of pressure drop is achieved by passage of the carbonated water through the channels 16 and through the channels 86 into the chamber 88. Alternatively, all of the carbonated water flow may be directed to the outside of the spout 14 or into the spout 14. The gradual reduction of pressure and velocity of the carbonated water stream is essential to minimizing foaming and maximizing the carbonation retention level of the finished drink.

It should be appreciated that in the first embodiment a greater volume of carbonated water is permitted to pass through the channels 16 than through the channels 86. It has been determined that only a small portion of the carbonated water need pass through the channels 86 and into the inner portion of the spout 14 to effectuate proper mixing with the syrup dispensed by the syrup distributor 70. The blending that occurs within the interior of the spout 14 in the chamber 88 is the first stage of carbonated water/syrup mixing and results in little foaming, since only a small quantity of the carbonated water is allowed to gently mix with the syrup. The configuration of the spout 14 permits another stage of pressure drop to occur as the carbonated water enters the chamber 88. An additional benefit of the present invention is that the carbonated water is allowed to rinse the spout 14 and thus cleanse the chamber 88 of any residual syrup.

The body 12 and spout 14 configuration of the present invention is also of unique design. The body 12 and spout 14 configuration allows most of the carbonated water, at the time that it passes through the channels 16 and meets the carbonated water flowing through the spout 14, to be substantially at atmospheric pressure. The channels 16 are larger than the channels 44 located within the second disk 42 but there are fewer of the channels 16 located about the periphery of the spout 14. These channels 16 allow the carbonated water to be broken up into many large streams that flow on the outside surface of the spout 14 and cling to the surface of the spout 14. To assist in the clinging of the stream to the spout 14, the spout 14 may be provided with a set of very fine serrations (not shown) along the outer surface of the spout 14. These serrations assist in causing the stream of carbonated water to follow closely to the surface of the spout 14. However, it should be appreciated that the serrations are not necessary providing the spout 14 is constructed with the grooves 18, 20 described below.

The spout 14 is designed such that a further reduction in the energy flow of the carbonated water is occasioned as the carbonated water leaves the second disk 42 and fills the area between the second disk 42 and the floor of the pouring spout 14. At the bottom of the spout 14 some of the water/syrup mixture collides with the streams of water coming down along the outside of the spout 14 through the channels 16, thus reducing the energy of the carbonated water.

As the carbonated water streams through the channels 16 of the body 12, the velocity of the water stream is further reduced by grooves 18, 20 located just below the channels 16 of the body 12. These grooves 18, 20 allow the many streams along the outside periphery of the spout 14 to blend into a single solid stream around the full periphery of the spout 14. This blending into a single stream eases the mixing of the syrup and carbonated water at the bottom of the spout 14.

The channels 16 also allow the carbon dioxide that has escaped, as a result of the lowering of the pressure of the carbonated water, to vent to the atmosphere without contacting the syrup. Thus, the foaming of the end product is substantially reduced. As stated earlier, it is known that carbon dioxide contacting the syrup is a major cause of foaming, as well as the relative velocity of the two fluids, that is the syrup and the carbonated water, blending together.

A further advantage of the present invention is that as the carbonated water flows down the outside of the spout 14 a small amount of the carbon dioxide is lost to the atmosphere and is thus prevented from mixing with the syrup. Also, the stream flowing along the outside of the spout 14 is slowed by the surface of the spout 14 departing from conventional spout assemblies which provide limited contact with the stream of carbonated water. Also, as the stream passes through the channels 16 and along the outside of the spout 14 it converges and blends with the carbonated water/syrup stream flowing through the chamber 88 and additional mixing is occasioned at the lower portion of the spout 14. Thus, dilution of the concentrated carbonated water/syrup stream by the first water stream passing along the outside of the spout 14 is done and the resultant confluence of the first stream and the second stream results in a gentle blending of the streams and additional mixing of the syrup with the carbonated water to result in a higher quality drink.

A second embodiment of the present invention illustrates a superflow diffuser and spout assembly 110 that is designed to be used with a plurality of different flavored syrups. In this second embodiment the superflow diffuser and spout assembly 110 includes a syrup distributor 112 which has a plurality of channels 114 which are operative to introduce different flavored syrups into the interior of the spout 120. The syrups are dispensed through a series of independent channels 122 which are spaced apart and thus permit dispensing of different flavors of syrup through one syrup distributor 112.

The superflow diffuser and spout assembly 110 includes a special shroud 130 which is fitted into the inner portion of the spout 120 and is retained within the spout 120 by locating the shroud 130 about the periphery of the syrup distributor 112. Retaining the shroud 130 within the spout 120 is accomplished by the use of an 0-ring 132 located within a groove 134. The shroud 130 has a plurality of channels 136 defined substantially within its upper portion to permit the introduction of carbonated water into the cavity 138 located between the outer periphery of the syrup distributor 112 and the inner wall of the shroud 130. A small annular channel 140 is present between the outer wall of the shroud 130 and the inner wall of the spout 120.

In this second embodiment the syrup distributor 112 has an outwardly extending terminal diffuser 142 integral with the syrup distributor 112. A plurality of diffuser elements 144 containing channels 146 are located between the terminal diffuser 142 and the first disk 148. The first disk 148 includes a series of channels 150 which are operative to introduce carbonated water into the cavity 152.

A second disk 154 containing a plurality of channels 156 is fitted below the terminal diffuser 142 and defines a second chamber 158 which opens into a plurality of channels 160, whereby the flow of carbonated water through the superflow diffuser and spout assembly 110 is diverted into two streams, one stream passing through the plurality of channels 160 the other stream passing through the plurality of channels 136.

The shroud 130 has a recessed portion 162 which defines a chamber 164 which results in a slightly longer "after-flow" to accomplish rinsing of the syrup from the mixing area to minimize flavor carryover. A controlled and limited portion of the carbonated water will flow through the channels 136 thus resulting in mixing of the carbonated water with the syrup flowing through the channels 122. An even smaller portion of the carbonated water will flow into the annular channel 140 between the outer periphery of the shroud 130 and the inner wall of the spout 120. This annular channel 140 carries a small portion of the carbonated water, without being mixed with the syrup, to effectuate rinsing of the pouring spout 120. The close fit between the shroud 130 and the spout 120 permitting only limited flow is effective to wash away any remaining syrup residue on the bottom edge of the shroud 130.

It should be appreciated that in the superflow diffuser and spout assembly 110 of the second embodiment a similar number of pressure drops are occasioned by the use of multiple chambers, diffuser elements and channels. Thus, the resulting carbonated water passing through the channels 160 is substantially at atmospheric pressure at the time that it passes along the outside of the spout 120 and mixes with the blended carbonated water/syrup mixture flowing through the shroud 130 and spout 120.

It should also be appreciated that a shroud may be used with the single flavor superflow diffuser and spout assembly 10 of the present invention, whereby the shroud can be located within the spout 14 to occasion washing of the spout of any residual syrup and reduction in the velocity of the distributed syrup resulting in a more gentle mixing of the syrup and carbonated water to reduce foaming. Furthermore, it should be appreciated that various configurations of channels may be located about the outside of the spout in either the first embodiment or the second embodiment to control the flow of carbonated water on the outside of the spout and thus vary the flow rate and mixing of the carbonated water/syrup.

Figure 3:
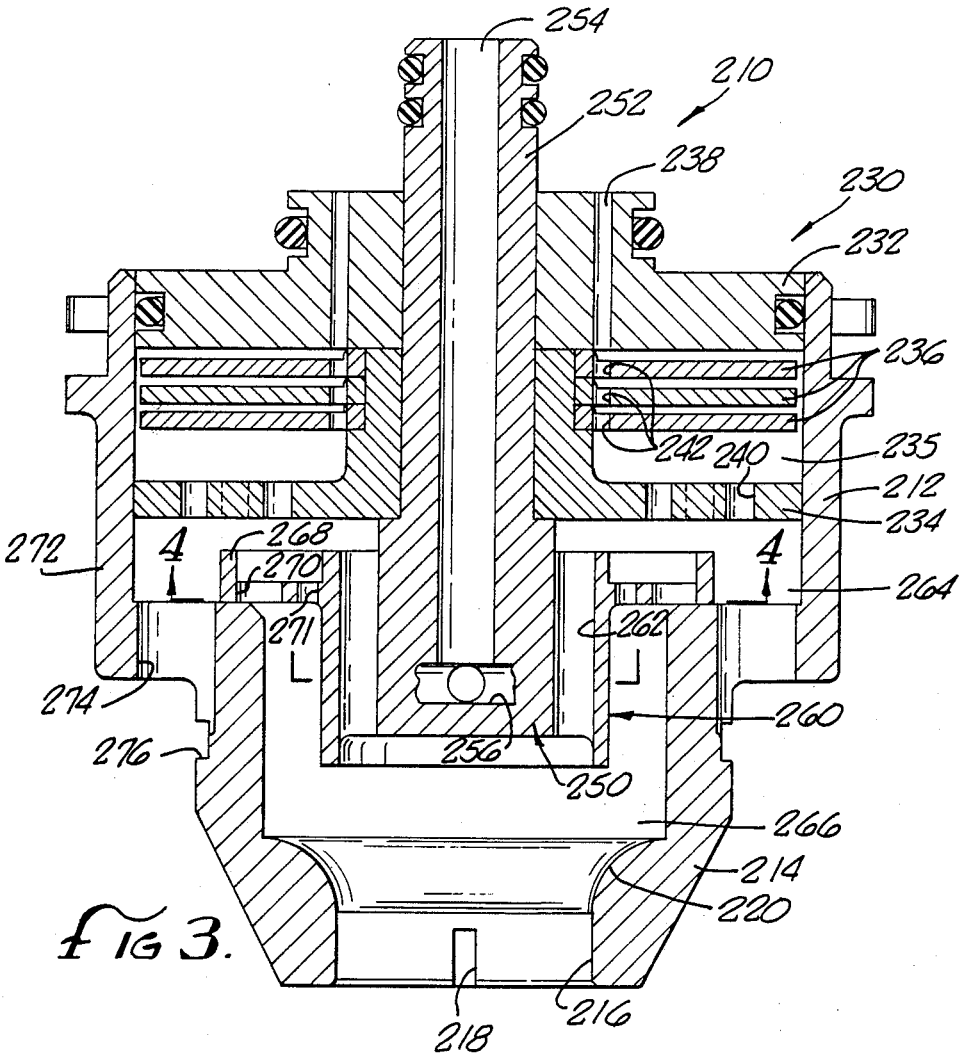
FIG. 3 is a side cross-sectional view of a third embodiment of the superflow diffuser and spout assembly of the present invention.
Figure 4:
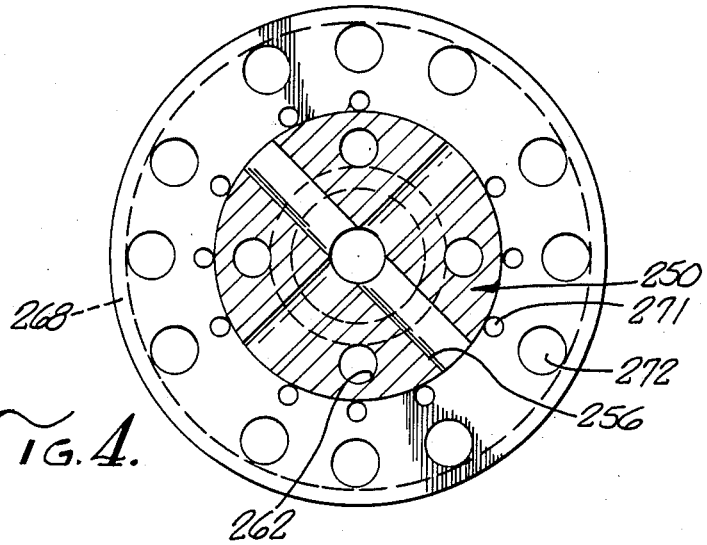
FIG. 4 is a lower elevation view of the third embodiment of the superflow diffuser and spout assembly of the present invention.

A third embodiment of the superflow diffuser and spout assembly of the present invention is shown in FIGS. 3 and 4 and is identified generally with numeral 210. The assembly 210 includes a body 212 which has a downwardly extending spout 214 integral therewith. The spout 214 has an opening 216 defined at one end and a slot 218 is cut into the wall of spout 214. The lower inner surface 220 of the spout 214 is convexly shaped to result in an improved discharge of fluid through the spout 214.

A diffuser assembly, identified generally with the numeral 230, is sized to fit within the body 212. The diffuser assembly 230 includes an upper disk 232 and a lower disk 234. Between the upper disk 232 and the lower disk 234 there are a plurality of diffuser elements 236 which are spaced apart from each other. A plurality of diluent inlets 238 are provided in the disk 232 and a plurality of diluent outlets 240 are provided in the disk 234. There are also a plurality of channels 242 provided in the elements 236, the channels 242 being located substantially in the center portion of the elements 236.

A syrup distributor, identified generally with the numeral 250, is located substantially in the center of the body 212. The syrup distributor 250 passes substantially through the center of the diffuser assembly 230 and has an upper portion 252, which includes a syrup inlet 254. At the lower portion of the syrup distributor 250 there are a plurality of syrup distribution ports 256 which are adapted to distribute syrup into the inner portion of the spout 214.

Also included within the body 212 is a flow separator, identified generally with the numeral 260, which includes a plurality of surfaces which are operative to separate flow within the assembly 210. The flow separator 260 includes a plurality of channels 262 which permit flow of fluid within the assembly 210 from the chamber 264 into the chamber 266.

The flow separator 260 also includes a radially extending portion 268, which includes a plurality of channels 270, 271 which are operative to permit flow from the chamber 264 into the chamber 266. Between the outer wall 272 of the body 212 and the spout 214 there are a plurality of channels 274 which permit flow of fluid from the chamber 264 to the outside of the assembly 210. There is a groove 276 defined along the outer surface of the spout 214 and positioned below the channels 274.

A bottom view of the radially extending portion 268 and syrup distributor 250 is shown in FIG. 4. The radially extending portion 268 includes spaced channels 271 and spaced channels 272. The channels 262 within the syrup distributor 250 and the syrup distribution ports 256 are also shown.

In the third embodiment of the superflow diffuser and spot assembly of the present invention, the upper disc inlets 238 are approximately 0.070 inches in diameter and there are eight of such inlets; the diluent outlets 240 are approximately 0.082 inches in diameter; and the channels 242 located in the elements 236 are approximately 0.093 inches in diameter. In the flow separator 260, the channels 270 are approximately 0.136 inches in diameter and the channels 271 are approximately 0.067 inches in diameter.

The operation of the superflow diffuser and spout assembly 210 of the third embodiment of the present invention is similar to the operation of the superflow diffuser and spout assemblies 10, 110. In operation, a diluent, such as carbonated water, is introduced through the channels 238 into the diffuser assembly 230. The diluent flows into the chamber 235, in which the diffuser elements 236 are located. The diluent passes through the channels 242 and in the space between the outer periphery of the diffuser elements 236 and the inner wall of the body 212. The diluent then flows from the chamber 235 through the channels 240 in the second disk 234 and into the chamber 264. Once in the chamber, 264 the diluent is separated into a plurality of flows; one of the flows flowing through the channels 274 to the outside of the apparatus 210, the other of the flows being separated into sub-flows which pass through the channels 270, 271. A certain portion of the diluent flow also passes through the channels 262 and directly into the chamber 266. The syrup passing through the ports 256 mixes with the flow of diluent passing through the channels 270, 271 and eventually mixes with the diluent passing through the channels 262. Thus, within the chamber 266 there is substantial mixing between the syrup and the diluent. After this preliminary mixing has occurred, the mixture consisting of syrup and diluent then passes through the opening 216 in the spout 214.

The superflow diffuser and spout assemblies 10, 110 and 210 of the present invention are useful with a complete beverage distribution system. A representative block diagram of components of a beverage distribution system is illustrated in FIGS. 5 and 6. Briefly, the beverage distribution system, referred to generally with the numeral 310, consists of a plurality of bag-in-box syrup-storage containers 312 and a plurality of mount pumps 314 in fluid communication with the bag-in-box containers 312. There is also included a gas tank 316 and a plurality of regulators 318. The gas tank 316 is in fluid communication with the regulators 318 and with the mount pumps 314. The mount pumps 314 are also in fluid communication through a plurality of syrup outlet lines 320 with a dispensing tower 322. The gas tank 316 is also in fluid communication with a carbonator, generally designated with the numeral 330, through a line 324. The carbonator 330 is in fluid communication with a water supply and in fluid communication with the dispensing tower 322, the carbonator having a water line 326 extending between the carbonator 330 and the tower 322 and a plurality of soda lines 328 extending between the carbonator 330 and the tower 322.

The components of the dispensing tower 322 are shown generally in FIG. 6. The superflow diffuser and spout assembly 10, 110, 210 of the present invention is attachable to the other components of the dispensing tower 322 by fitting the superflow diffuser and spout assembly 10, 110, 210 through an aperture defined within a base plate 412. The base plate 412 is attached to a front block 414, which includes a mounted solenoid bracket 416, which contains a solenoid 418. Common electrical circuitry and connections 420 are included with the solenoid 418.

An actuation lever 422 is rotatably attached to the front block 414; the lever 422 intended to be used by the operator to control the filling cycle. The front block 414 is attached to a back block 424 which contains a syrup outlet 426 and carbonated water outlet 428. A locking mechanism 430 is provided with the back block 424 to rigidly affix the front block 414 to the back block 424. The back block 424 is rigidly affixed to the other cabinetry included with the dispensing tower 322. An external syrup supply line 432 and an external carbonated water supply line 434 are engageable with the back block 424 to provide a source or supply of syrup and carbonated water to the dispensing tower 322.

It will be obvious to those skilled in the art that various changes may be made without departing from the spirit of the present invention, and therefore the invention is not limited to what is shown in the drawings and described in detail in this specification but only as indicated in the appended claims.

We claim:

1. A superflow diffuser and spout assembly for use with a liquid dispensing apparatus, comprising:

a body, an inlet in said body for receiving a supply of carbonated water, an inlet in said body for receiving a supply of syrup, a diffuser assembly in said body through which at least a portion of said carbonated water supply passes prior to being dispensed, a spout attached to said body, a flow separator within the path of said carbonated water supply, a syrup distributor in said spout for distributing said supply of syrup into a plurality of streams, wherein said flow separator is operative to separate said carbonated water supply into at least three streams, a first stream directed to flow along an outside surface of said spout, a second stream directed to flow through said spout, a third stream directed through said syrup distributor, wherein said second stream flowing through said spout mixes with syrup distributed from said syrup distributor, and said third stream of carbonated water mixes with said second stream of carbonated water then mixed with syrup, wherein and said fist stream of carbonated water and said second stream of carbonated water, then mixed with syrup and said third stream of carbonated water, meet for dispensing downstream of said spout.

2. A beverage distribution system, comprising:

a plurality of syrup storage containers, a plurality of pumps in fluid communication with said syrup storage containers, a supply of gas, a plurality of regulators, said gas supply in fluid communication with said regulators and said pumps, a plurality of syrup outlet lines operative to transport syrup from said pumps to a dispensing tower, said dispensing tower including electrical components operative to control a flow of syrup and a flow of carbonated water, said dispensing tower adapted to receive a superflow diffuser and spout assembly, said superflow diffuser and spout assembly comprising:

a body, a spout attached to said body, a first disc, said first disc including a plurality of channels, a second disc, said second disc including a plurality of channels, a diffuser assembly, said diffuser assembly comprising a plurality of discs, said diffuser discs having a plurality of channels, said diffuser assembly discs being located between said first disk and said second disk, a plurality of channels defined within said body, said body channels located about the periphery of said spout, a syrup distributor, said syrup distributor operative to introduce syrup into said spout, a flow separator, said flow separator operative to separate said flow of carbonated water within the superflow diffuser and spout assembly into at least a first and second stream of carbonated water, said first stream of carbonated water flowing through said body channels along an outside surface of said spout, said second stream of carbonated water flowing into the interior of said spout, said second stream of carbonated water directed to meet and collide with said syrup introduced into said spout to occasion mixing of said carbonated water and said syrup, said first stream flowing along said outside surface of said spout and said second stream of carbonated water, including syrup, converging at a lower portion of said spout for dispensing.

3. The beverage distribution system of claim 2, wherein said gas supply is in fluid communication with a carbonator and said carbonator is in fluid communication with a water supply, which further includes a water supply line extending between said dispensing tower and said carbonator, and a plurality of carbonated water lines extending between said dispensing tower and said carbonator.

4. The beverage distribution system of claim 2 or 3, wherein said flow separator is operative to separate the flow of carbonated water through the superflow diffuser and spout assembly into at least three streams of carbonated water, said first stream of carbonated water flowing through said body channels along an outside surface of said spout, said second stream of carbonated water flowing into the interior of said spout, said third stream of carbonated water flowing through said syrup distributor into said spout, said second and third streams of carbonated water directed to meet and collide with said syrup introduced into said spout to occasion mixing of said carbonated water and said syrup, said first stream flowing along said outside surface of said spout and said second and third streams of carbonated water, including syrup, converging at a lower portion of said spout for dispensing.

* * * * *